US006503388B1

(12) United States Patent
Reesink

(10) Patent No.: US 6,503,388 B1
(45) **Date of Patent: *Jan. 7, 2003**

(54) PROCESS FOR THE HYDROGENATION OF A THIOPHENIC SULFUR CONTAINING HYDROCARBON FEED

(75) Inventor: Bernard Hendrik Reesink, Doorn (NL)

(73) Assignee: Engelhard de Meern B.V., De Meern (NL)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/000,021

(22) PCT Filed: Jul. 10, 1996

(86) PCT No.: PCT/NL96/00282

§ 371 (c)(1),
(2), (4) Date: May 21, 1998

(87) PCT Pub. No.: WO97/03150

PCT Pub. Date: Jan. 30, 1997

(30) Foreign Application Priority Data

Jul. 13, 1995 (EP) ..... 95201938

(51) Int. Cl.[7] ..... C10G 45/00; C07C 5/02

(52) U.S. Cl. ..... 208/144; 208/143; 585/275; 585/276

(58) Field of Search ..... 208/143, 144; 585/276, 275

(56) References Cited

U.S. PATENT DOCUMENTS

| | | | | | |
|---|---|---|---|---|---|
| 3,269,939 | A | * | 8/1966 | Marechal et al. | 208/143 |
| 3,537,981 | A | * | 11/1970 | Parker | 208/143 |
| 3,943,053 | A | * | 3/1976 | Kovach et al. | 208/143 |
| 4,145,276 | A | * | 3/1979 | Cosyns et al. | 208/57 |
| 4,175,033 | A | * | 11/1979 | Hilfman | 208/143 |
| 5,346,612 | A | * | 9/1994 | Kukes et al. | 208/143 |

* cited by examiner

*Primary Examiner*—Walter D. Griffin
*Assistant Examiner*—Tam M. Nguyen
(74) *Attorney, Agent, or Firm*—Weingarten, Schurgin, Gagnebin & Lebovici LLP

(57) ABSTRACT

The invention is directed to a process for the hydrogenation of a hydrocarbon feed containing thiophenic sulfur contaminants, wherein the entire feed is contacted with a nickel catalyst, the improvement comprising contacting the said feed additionally with a platinum group metal prior to or simultaneously with contacting the nickel.

13 Claims, 1 Drawing Sheet

PROCESS FOR THE HYDROGENATION OF A THIOPHENIC SULFUR CONTAINING HYDROCARBON FEED

The present invention is directed to a process for the hydrogenation of a thiophenic sulfur containing hydrocarbon feed, more in particular to dearomatization of solvents, middle distillates such as diesels, 'white oils', gasoline and the like.

BACKGROUND

When hydrogenation catalysts are used in the hydrogenation of heavy feeds, such as petroleum distillates, often a problem presents itself in that the feed comprises sulfur and/or sulfur components, which adversely affect the lifetime of the catalyst. In such processes conventional hydrogenation catalysts are usually applied, for instance supported nickel catalysts. To reduce this problem of deactivation, much attention has been paid to the removal of sulfur-compounds from the gaseous or liquid feed prior to the hydrogenation.

In general sulfur impurities are present in feeds as mercaptans or thiophenes, more in particular thiophene, dithiophene, benzothiophene, dibenzothiophene, as well as substitution products thereof, which sulfur impurities can be hydrogenated to $H_2S$ using a sulfidized Co—Mo catalyst. The $H_2S$ formed is then removed from the feed by stripping, or by reaction with activated zinc oxide. This method is also known as hydrodesulfurization (HDS).

After separation of the hydrogen sulfide from the HDS-treated feed, and concentration of the hydrogen sulfide, it is usually processed to elemental sulfur in a conventional Claus process.

Under certain conditions, particularly when the sulfur content of the feed is not too high, it is economical not to remove the sulfur compounds completely prior to the hydrogenation process, but to allow a gradual deactivation of the catalyst, as the catalyst takes up the sulfur. After the deactivation of the catalyst has proceeded to a level that the activity becomes uneconomically low, the catalyst is replaced.

Since there is a need for processing feeds having a higher content of sulfur compounds than has been conventional up to now, which would lead to an unacceptably short lifetime of the catalyst, it is desirable to have a catalyst system with a reduced sensitivity to deactivation by sulfur compounds, i.e. having an increased on-stream time.

The product stream obtained from the HDS process still contains some sulfur. Typical sulfur levels of these product streams from HDS-units range from 0.1 to 300 ppm.

In the subsequent hydrogenation step, using a nickel catalyst, the major part of the sulfur is taken up by the nickel, as discussed above. Accordingly, the nickel catalyst will be deactivated in the course of time.

The on-stream time of a nickel catalyst in these systems depends i.a. on the amount of sulfur impurities or contaminants in the feed. However, it has been found, that the nature of the sulfur compounds also has a marked influence on the deactivation. Thiophenic sulfur has been found to have a much larger negative influence than mercaptans or hydrogen sulfide.

Thiophenic sulfur has been defined herein to include those organic compounds that include at least one thiophene ring, including, but not limited to thiophene, dithiophene, benzothiophene, dibenzothiophene, as well as substitution products thereof.

It has been proposed in EP-A 398,446 to provide a catalyst for hydrogenation and/or dehydrogenation having improved resistance against deactivation by sulfur and/or sulfur compounds, said catalyst comprising at least one hydrogenation component, at least one metal-oxide containing component and at least one support material, at least a part of the hydrogenation,component, as well as at least a part of the metal-oxide containing component being present on said support material as separate particles, and the particles of the hydrogenation component and the particles of the metal-oxide. containing component being homogeneously distributed in the catalyst.

Although this catalyst provided a distinct improvement over the prior art there still is a need for further improvement, especially in terms of the amount of sulfur that can be taken up by the nickel before it has to be replaced.

SUMMARY OF THE INVENTION

The present invention is based on the surprising discovery, that the thiophenic sulfur resistance of a nickel hydrogenation catalyst can be improved by contacting the entire thiophenic sulfur containing hydrocarbon feed with a platinum group metal (to be defined hereafter) prior to or simultaneously with contacting the said feed with the nickel catalyst.

DETAILED DESCRIPTION OF THE INVENTION

Figure 1:
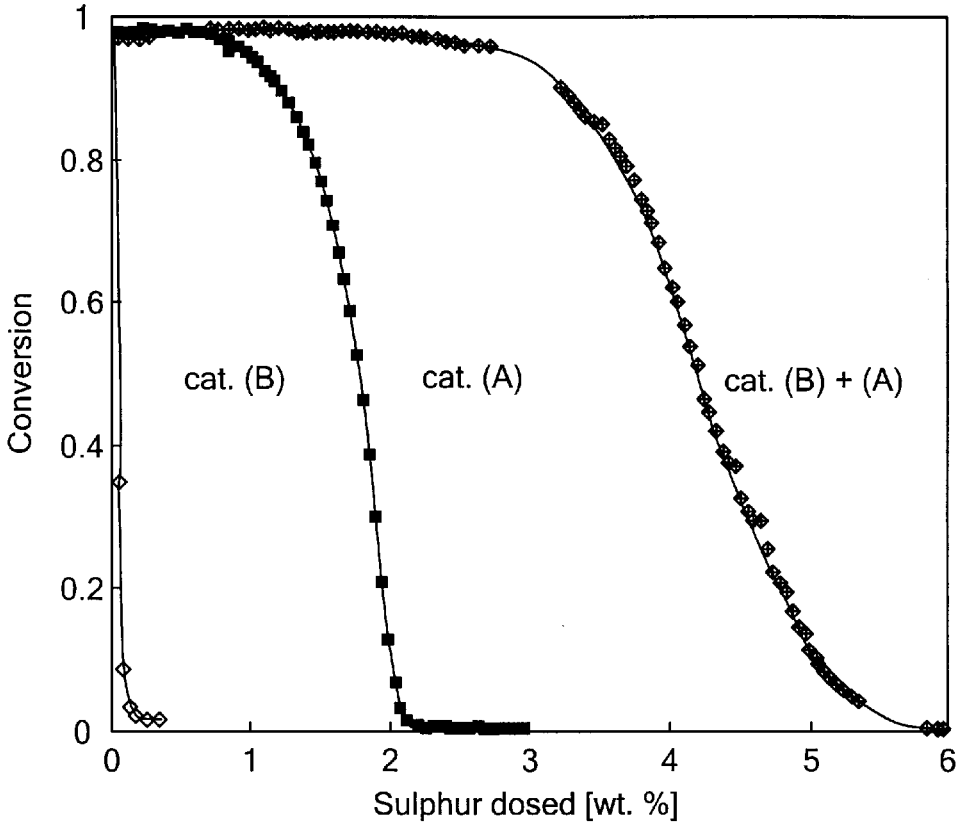
FIG. 1 shows a graph plotting the hydrogenation activity (conversion rate, on the y-axis) against the thiophene sulfur dosage in the feed (% sulfur dosed, on the x-axis), for hydrogenation processes using various catalysts as described in the Examples.

Thiophenic sulfur content of not more than 300 ppm, preferably no more than 100 ppm, additionally with a platinum group metal prior to or simultaneously with contacting the nickel.

According to a second embodiment the present invention comprises a process wherein a hydrocarbon feed containing thiophenic sulfur contaminants is additionally contacted with a platinum group metal selected from the group consisting of platinum, palladium, ruthenium, and combinations of two or more of these metals prior to or simultaneously with contacting the nickel.

The sulfur resistance of the nickel, more in particular the resistance against thiophene sulfur in the feed, increases tremendously when the feed is additionally contacted with the platinum group metal.

There are various ways in which to carry out the process of the present invention. In a first way the platinum group metal, as defined hereinafter, is provided in the form of a first catalyst bed, through which the feed is passed, together with hydrogen, prior to passing it through the bed of the nickel catalyst. The platinum group metal is either present in a separate reactor, or in the first part of a catalyst bed, the second part of which consists of the nickel catalyst. The total of the reaction mixture from the said first catalyst bed is subsequently passed through the nickel catalyst for the actual hydrogenation step. This means that all feed material (on an atomic basis) introduced into the platinum group metal catalyst bed, is subsequently passed through the nickel catalyst bed.

In a second way the platinum group metal catalyst is dispersed through the nickel catalyst, for example as a physical mixture of supported particles of the platinum group metal and supported particles of nickel. It is also possible to have the platinum group metal and the nickel metal supported on the same support.

The preference for each of these ways depends on the actual configuration and conditions of the process. An important aspect may be the requirement that the metals can be reclaimed, which will be easier in case the catalyst metals are kept separate.

The use of combined nickel and platinum catalysts is known for increasing the selectivity of the benzene hydrogenation, by decreasing the amount of coke formed, or by suppressing the hydrogenolysis reaction. These catalysts are always used with a feed that is essentially sulfur free.

It is also remarked, that USSR patent No. 530494 describes the use of a nickel and platinum catalyst on chromium oxide, for the hydrogenation of sulfolene-3, whereby the presence of platinum increases the stability of the catalyst against sulfur dioxide.

EP-A 573,973 mentions the use of a three component catalyst for HDS processes. The first component is selected from molybdenum and tungsten, the second from cobalt and nickel and the third component from renium and iridium. This document concerns an entirely different process, namely the desulfurization of gas oils having a high content of sulfur compounds, such as up to 1% by weight or more. Contrary thereto the present invention is directed to treating feedstocks having a much lower content of sulfur. More in particular the present invention is directed to treating the oils produced by processes of the type disclosed in this document.

The platinum group metal used in the process of the present invention may be selected from the group consisting of platinum, palladium, ruthenium, iridium, rhodium, osmium and rhenium, as well as combinations of two or more of these metals. A preferred group consists of the metals platinum, palladium, and ruthenium, while platinum and palladium, more in particular platinum are the most preferred. It is remarked, that it is uncertain in which chemical form the metal is active. This may be the pure metal, but it is also possible that the metal sulfide is at least partly responsible for the increase in the sulfur resistance.

In further embodiments of the process of the invention modifications can be made in reactor configuration and process design, at least partly depending on the nature of the feed and the temperature required for the hydrogenation.

As the platinum group metal has the tendency to work more effectively at somewhat higher temperatures, such as above 150° C., dependent on the thiophenic sulfur species present, it may be that the lighter hydrocarbons already have been hydrogenated at the temperature that the platinum group metal starts to function. In such a situation initially the sulfur deactivates the catalyst. This results therein that the product tends to become 'off-spec'. In order to maintain the activity and accordingly the product specifications, the temperature at the reactor entrance is increased. As a result of this way of operating the platinum group metal will start to function, once the required minimum temperature has been reached. The activity will then be maintained at the same level, with the same temperature regime for a long time.

In such a situation it may also be advantageous to have two reactors, each containing a mixture or combination of both nickel and platinum group catalyst. The feed is first passed through the first reactor, wherein the nickel takes up the sulfur. Once the sulfur front reaches the second reactor, the temperature in the first reactor is increased resulting therein that the platinum group metal starts to function and the capacity of the nickel for the sulfur uptake increases. Accordingly the sulfur front will no longer move in the second reactor and the reactor will maintain its hydrogenation capacity. If necessary the temperature may be further increased in the course of time. The heat required for this may be provided by heat exchange with the feed of the second reactor, that is the product stream from the first reactor.

Various heavier feeds, especially those containing higher sulfur compounds, such as dithiophene, benzothiophene and dibenzothiophene, require a rather high temperature for the hydrogenation, with the result that the temperature to be used for the hydrogenation corresponds to the temperature at which the platinum group metal is most effective.

In the present invention any nickel catalysts, suitable for the hydrogenation of hydrocarbons may be used. The amount of nickel to be used in the hydrogenation catalyst can be selected within wide ranges, depending on the requirements of the process. These amounts can vary from as low as 5% by weight of nickel (as metal) to 95% by weight, calculated on the basis of the total weight of the nickel catalyst. It is possible to use unsupported nickel, i.e. Raney Nickel, but it is preferred to use supported catalysts.

In case the hydrogenation catalyst is supported, the amounts of nickel will generally not exceed about 85 wt. %. High amounts of nickel are preferred, i.e. above about 45 wt. % of the total amount of catalyst. The nickel is optionally promoted with one or more promoters.

The amount of platinum group metal may also vary, whereby the amount thereof generally is lower than the amount of nickel. The preferred range is from 0.001 wt. % to 5 wt. % of platinum group metal, calculated on the combined weight of the platinum group metal catalyst and the nickel catalyst, or on the weight of the catalyst containing both the platinum group metal and the nickel metal, depending on which embodiment is used. In case platinum is used the amount thereof will preferably be between 0.001 and 0.5 wt. %, and palladium is preferably used in the range of 0.001 to 1.5 wt. %. In case any one of the other platinum group metals is used, higher amounts may be applied, depending on the activity of the metal.

The amount of platinum group metal catalyst influences the increase in the improvement in the sulfur resistance of the nickel catalyst. Higher amounts of platinum group metal increase the resistance against deactiviation, whereas lower, amounts result in lower resistance. Also the temperature and the dispersion of the platinum group metal influence the improvement in the resistance against deactivation by sulfur.

The nickel catalyst used according to the invention can be prepared in different ways using techniques known per se. Examples of such techniques are the application of the active nickel component and/or components or precursors thereof to a support material by means of impregnation or precipitation, followed by drying and, if necessary, conversion to a catalytically active material. This may for instance comprise calcining the dried material followed by reducing the calcined material.

The platinum group metal catalyst can be any suitable, preferably supported, platinum group metal catalyst. As indicated previously this catalyst may be present in a separate reactor, as a separate layer in the same reactor as the nickel catalyst, or in admixture with the nickel catalyst.

In the alternative it is possible to apply the platinum group metal on the same support as the nickel metal. Any technique suitable for this may be used.

As a support the conventional supports for hydrogenation catalysts can be used, such as silica, alumina, silica-alumina, titania, zircbnia, active carbon, zeolites, natural or synthetic clays, and combinations of two or more of these supports.

The catalyst may be used in various forms, such as powder, pellets or extrusions. What form is chosen depends on the nature of the reaction and the type of reactor that is used.

In the process of the present invention it suffices to use as the active components only nickel and the platinum group metal. No further active components to increase the resistance against deactivation are necessary.

The process according to the invention comprises in its most general sense reactions in which hydrocarbon feeds containing thiophenic sulfur contaminants are hydrogenated. An important class of these feeds is formed by the various sulfur containing petroleum distillates. Examples of such reactions are inter alia the hydrogenation of benzene, "white oils", gasoline, middle distillates, such as diesel and kerosene, and solvents. More in particular the process is to be used for hydrogenating, more in particular dearomatizing; hydrocarbon feeds that contain thiophenic sulfur contaminants. The hydrocarbon materials to be hydrogenated do not contain sulfur atoms in the molecules, apart from the presence of sulfur compounds as contaminant.

The process according to the invention can be carried out in various types of reactors which are suitable for hydrogenation, such as solid bed reactors, fluid bed reactors, trickle-phase reactors and the like.

The process conditions are the known ones used for the hydrogenation of the feeds used, whereby it is to be noted, that for an optimal effect of the platinum group metal catalyst a temperature of between 50 and 350° C. is preferred.

In case the amount of $H_2S$ in the gasphase is below 10 ppm, the preferred optimal temperature for the nickel catalyst is below 275° C.

Generally suitable conditions for the hydrogenation process comprise hydrogen pressures between 0.5 and 300 bar, temperatures between 50 and 350° C. and liquid hourly space velocities (LHSV) between 0.1 and 10 $h^{-1}$.

The invention is further elucidated on the basis of the following, non restrictive, examples.

EXAMPLES

Various experiments were done to determine the hydrogenation efficiency and the deactivation of the catalyst by thiophenic sulfur. The following catalysts were used:

A: 56 wt. % nickel on silica

B: 5 wt. % platinum on alumina

C: 1 wt. % platinum on alumina

Comparative Examples 1 and 2

In a first set of experiments in an atmospheric microreactor benzene hydrogenation to cyclohexane was used as a model reaction for aromatics hydrogenation. The conditions of the reaction were as follows:

| | |
|---|---|
| Pressure | 1 bar |
| Temperature | 250° C. |
| GHSV | 12000 $h^{-1}$ |
| Benzene concentration | 6 vol. % |
| Catalyst weight | 25 mg |

In comparative example 1 a standard nickel catalyst, 56wt. % nickel on silica (A) was used and in comparative example 2 a standard platinum catalyst, 5 wt. % platinum on alumina (B), was used. During the hydrogenation thiophene was added to the reactor, resulting in both cases in a very fast deactivation of each catalyst. In the case of the nickel catalyst (comparative example 1) deactivation was complete after a sulfur addition (as thiophene) of about 2 wt. %. The platinum catalyst; (comparative example 2) was deactivated after addition of about 0.15 wt. % of thiophene. The results are included in FIG. 1.

Example 1

Under the same conditions as in comparative examples 1 and 2, an experiment was carried out using first a bed of catalyst B and passing the entire product stream from said bed through a bed of the same volume of catalyst A. The hydrogenation activity was now maintained until the thiophene dosage exceeded 5 wt. % (see FIG. 1). When using a larger bed of nickel the deactivation would have occurred even later. Comparative Examples 3 and 4, and Examples 2 and 3

In a high pressure fixed-bed laboratory reactor a typical high boiling distillate (Boiling range 200–300° C.) was used as feed. The feed was spiked with 20 ppm thiophene. The following conditions were applied:

| | |
|---|---|
| Pressure | 60 bar |
| Temperature | 180° C. |
| LHSV | 47 $h^{-1}$ |
| GHSV | 4700 $h^{-1}$ |
| Catalyst volume | 1.5 $cm^3$ |

In the comparative example 3 catalyst A was used. The catalyst showed a good solvent conversion. The hydrogenation activity diminished after 46 h on stream. The spent catalyst contained 3.3 wt. % sulfur. In comparative example 4 catalyst C was used. The activity and solvent conversion were low.

Figure 2:
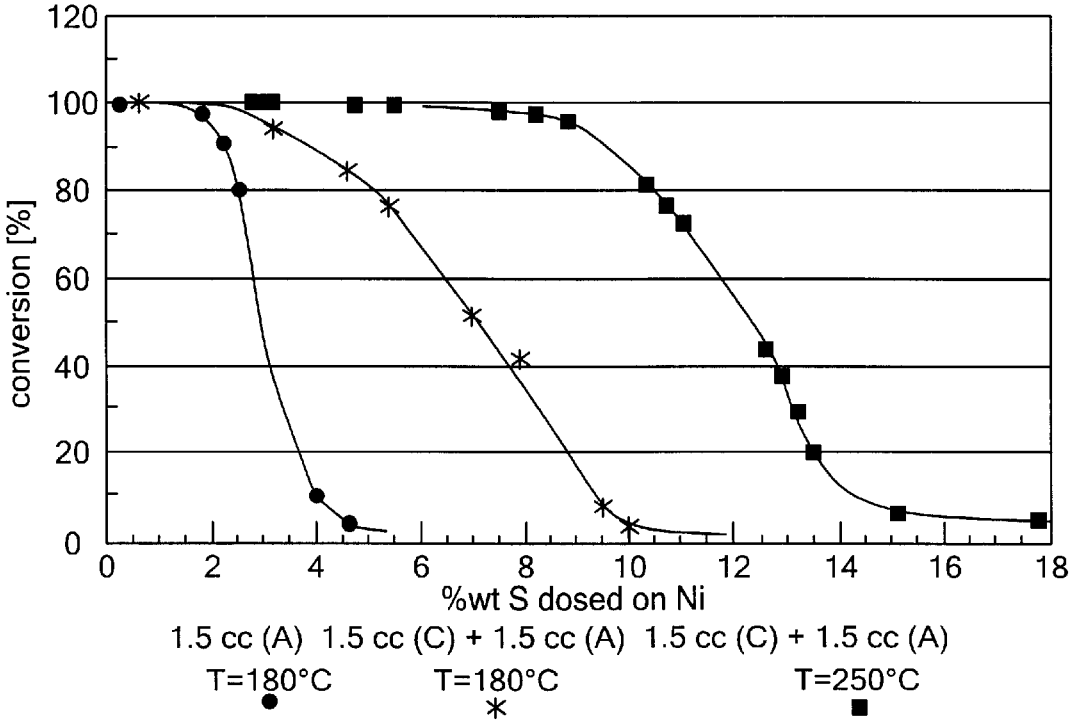
FIG. 2 shows a graph plotting the catalyst's hydrogenation activity (% conversion, on the y-axis) against the thiophene sulfur dosage in the feed (%wt S dosed on Ni, on the x-axis), for hydrogenation processes using various catalysts and temperatures as described in the Examples.

Using first a bed of catalyst C, followed by a bed of the same volume of catalyst A, through which bed the entire product stream of the bed of catalyst C was passed, the on-stream time could be increased until a sulfur uptake of about 8 wt. % (spent catalyst analysis) in the nickel catalyst was reached (see FIG. 2).

The same experiment was carried out using a temperature of 250° C., resulted in a further increase in the sulfur uptake in the nickel catalyst, as apparent from analysis of the spent catalyst, to about 14 wt. %.

Further increase of the volume of the bed of nickel catalyst would lengthen the on stream time of the hydrogenation substantially.

What is claimed is:

1. A process for the hydrogenation of a hydrocarbon feed, said feed having been previously treated to remove a substantial portion of thiophenic sulfur, wherein said previously treated feed contains thiophenic sulfur contaminants in an amount of not more than 100 ppm, consisting essentially of the steps of:

contacting said feed with a platinum group metal simultaneous with nickel metal; or contacting said feed with a platinum group metal resulting in a platinum-treated feed and subsequently contacting the platinum-treated feed with nickel metal, wherein said nickel metal is substantially free from molybdenum, wherein said nickel metal further absorbs said sulfur contaminants from said feed and wherein each of said contacting steps is carried out under conditions effective for removing said thiophenic sulfur from said feed.

2. A process for the hydrogenation of a hydrocarbon feed, said feed having been previously treated to remove a substantial portion of thiophenic sulfur, wherein said previously treated feed contains thiophenic sulfur contaminants in an amount of not more than 100 ppm, consisting essentially of the steps of:

contacting said feed with a platinum group metal selected from the group consisting of platinum, palladium, ruthenium, and combinations of two or more of these metals, simultaneous with nickel metal; or contacting said feed with a platinum group metal selected from the group consisting of platinum, palladium, ruthenium, and combinations of two or more of these metals, resulting in a platinum-treated feed and subsequently contacting the platinum-treated feed with nickel metal, wherein said nickel metal is substantially free from molybdenum, wherein said nickel metal further absorbs said sulfur contaminants from said feed and wherein each of said contacting steps is carried out under conditions effective for removing said thiophenic sulfur from said feed.

3. A process for the hydrogenation of a hydrocarbon feed, said feed having been previously treated to remove a substantial portion of thiophenic sulfur, wherein said previously treated feed contains thiophenic sulfur contaminants in an amount of not more than 100 ppm, consisting essentially of the steps of:

contacting said feed with a platinum group metal, said platinum group metal being substantially free from molybdenum and tungsten, simultaneous with nickel metal; or contacting said feed with a platinum group metal, said platinum group metal being substantially free from molybdenum and tungsten, resulting in a platinum-treated feed, and, subsequently contacting the platinum-treated feed with nickel metal, wherein said nickel metal is substantially free from molybdenum, wherein said nickel metal further absorbs said sulfur contaminants from said feed and wherein each of said contacting steps is carried out under conditions effective for removing said thiophenic sulfur from said feed.

4. A process for the dearomatization of a hydrocarbon feed by hydrogenation of said feed, said feed having been previously treated to remove a substantial portion of thiophenic sulfur, wherein said previously treated feed contains thiophenic sulfur contaminants in an amount of not more than 100 ppm, consisting essentially of the steps of:

contacting said feed with a platinum group metal simultaneous with nickel metal; or contacting said feed with a platinum group metal, resulting in a platinum-treated feed, and, subsequently contacting the platinum-treated feed with nickel metal, wherein said nickel metal is substantially free from molybdenum, wherein said nickel metal further absorbs said sulfur contaminants from said feed and wherein each of said contacting steps is carried out under conditions effective for removing said thiophenic sulfur from said feed.

5. A process for the hydrogenation of a hydrocarbon feed, said feed having been previously treated to remove a substantial portion of thiophenic sulfur, wherein said previously treated feed contains thiophenic sulfur contaminants in an amount of not more than 100 ppm, said feed having been produced by an upstream hydrodesulfurization unit, the process consisting essentially of the steps of:

contacting said feed with a platinum group metal simultaneous with nickel metal; or contacting said feed with a platinum group metal resulting in a platinum-treated feed and subsequently contacting the platinum-treated feed with nickel metal, wherein said nickel metal is substantially free from molybdenum, wherein said nickel metal further absorbs said sulfur contaminants from said feed and wherein each of said contacting steps is carried out under conditions effective for removing said thiophenic sulfur from said feed.

6. A process according to claim 1, 4, or 3, wherein said platinum group metal is selected from the group consisting of platinum, palladium, ruthenium, iridium and combinations of two or more of these metals.

7. A process according to claim 1, 4, 2 or 3, wherein the platinum group metal is present in a separate bed, either in the same reactor or in a separate reactor, through which separate bed the feed is passed, prior to passing the entire feed through a bed containing the nickel metal.

8. A process according to claim 1, 4, 2 or 3, wherein the platinum group metal and the nickel metal are present in the same bed.

9. A process according to claim 1, 4, 2 or 3, wherein the platinum group metal and the nickel metal are present on the same support.

10. A process according to claim 1, 4, 2 or 3, wherein the amount of the platinum group metal is between 0.001 and 5 wt. % of the combined weight of the nickel metal and the platinum group metal.

11. A process according to claim 1, 4, 2 or 3, wherein the hydrocarbon feed containing thiophenic sulfur.

12. A process according to claim 1, 4, 2 or 3, wherein the feed is the product produced by an upstream hydrodesulfurization unit.

13. A process according to claim 1, 4, 2 or 3, wherein the feed is contacted with the platinum group metal and the nickel metal at temperatures in the range of 50 to 350° C.

* * * * *

UNITED STATES PATENT AND TRADEMARK OFFICE

CERTIFICATE OF CORRECTION

PATENT NO. : 6,503,388 B1 
DATED : January 7, 2003
INVENTOR(S) : Bernard Hendrik Reesink It is certified that error appears in the above-identified patent and that said Letters Patent is hereby corrected as shown below:

Column 2,
After "Detailed Description of the Invention", delete lines 45-48 and insert the following paragraph:
-- In a first embodiment, the present invention is accordingly directed to a process for the hydrogenation of a hydrocarbon feed containing thiophenic sulfur contaminants, where in the entire feed is contacted with a nickel catalyst, the improvement comprising contacting the said feed having a thiophenic sulfur content of not more than 300 ppm, preferably no more than 100 ppm, additionally with a platinum group metal prior to or simultaneously with contacting the nickel. --; and Column 5,
Line 9, "zircbnia," should read -- zirconia, --.

Signed and Sealed this

Twenty-fifth Day of October, 2005

JON W. DUDAS
*Director of the United States Patent and Trademark Office*

UNITED STATES PATENT AND TRADEMARK OFFICE

CERTIFICATE OF CORRECTION

PATENT NO. : 6,503,388 B1 
DATED : January 7, 2003
INVENTOR(S) : Bernard Hendrik Reesink It is certified that error appears in the above-identified patent and that said Letters Patent is hereby corrected as shown below:

Column 8,
Line 61, should read -- A process according to claim 8, wherein the amount of the platinum group metal is between 0.001 and 5 wt. % of the combind weight of the nickel metal and platinum group metal. --.

Signed and Sealed this

Twenty-seventh Day of December, 2005

JON W. DUDAS
*Director of the United States Patent and Trademark Office*